United States Patent [19]

Roberts

[11] Patent Number: 4,630,863

[45] Date of Patent: Dec. 23, 1986

[54] PORTABLE SEAT

[75] Inventor: Frank L. Roberts, Thornhill, Canada

[73] Assignee: Bio-Support Industries Ltd., Toronto, Canada

[21] Appl. No.: 773,716

[22] Filed: Sep. 9, 1985

[51] Int. Cl.[4] ..... A47C 27/16

[52] U.S. Cl. ..... 297/219; 297/456; 297/459

[58] Field of Search ..... 297/458, 459, 219, 229, 297/230, 231, 456, 252

[56] References Cited

U.S. PATENT DOCUMENTS

| | | | |
|---|---|---|---|
| 1,422,908 | 7/1922 | Wittcoff | 297/229 X |
| 2,013,481 | 9/1935 | Stonehill | 297/231 X |
| 2,507,639 | 5/1950 | Ledbetter | 297/252 |
| 2,865,433 | 12/1958 | Warner | 297/252 X |
| 3,069,203 | 12/1962 | Propus | 297/229 X |
| 3,140,897 | 7/1964 | Dougherty | 297/229 X |
| 3,177,036 | 4/1965 | Halter | 297/454 |
| 3,222,694 | 12/1965 | Schick | 297/219 X |
| 3,288,525 | 11/1966 | Cerf | 297/284 |
| 3,511,537 | 5/1970 | Ackermann | 297/458 |
| 3,740,096 | 6/1973 | Bridger | 297/459 |
| 3,778,104 | 12/1973 | Kusters | 297/458 |
| 4,036,524 | 7/1977 | Takamatsu | 297/219 |
| 4,148,521 | 4/1979 | Van Hook | 297/456 X |
| 4,179,158 | 12/1979 | Flaum et al. | 297/456 X |
| 4,218,090 | 8/1980 | Hoffacker et al. | 297/214 |

FOREIGN PATENT DOCUMENTS

| | | | |
|---|---|---|---|
| 342428 | 2/1931 | United Kingdom | 297/459 |

*Primary Examiner*—Francis K. Zugel

*Attorney, Agent, or Firm*—Kenneth M. Garrett

[57] ABSTRACT

An orthopedic seat comprises three portions that are linked together to permit the seat to be folded into a compact package for carrying. The linkage permits the forward portion of the seat to be detached so as to adapt the seat for use with chairs having a small back to front dimension.

9 Claims, 7 Drawing Figures

FIG. 1.
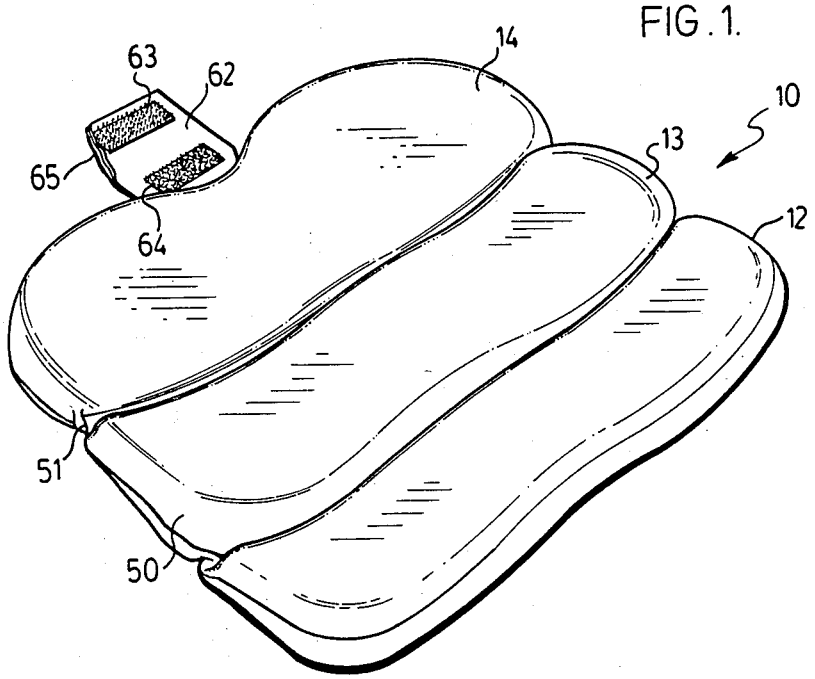
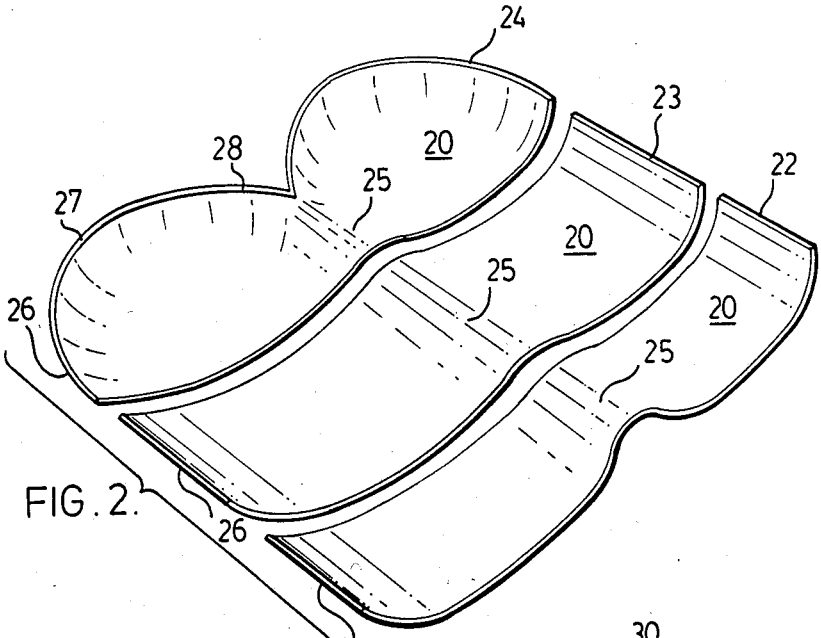
FIG. 2.
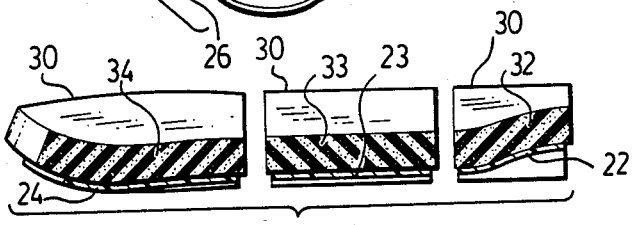
FIG. 3.

PORTABLE SEAT

FIELD OF THE INVENTION

This invention relates to a seat. It particularly relates to a seat of an orthopedic nature. It further relates to a seat that may be easily transported and that is adapted for use under a variety of conditions.

BACKGROUND OF THE INVENTION

Orthopedic seats may be generally characterized as seats that are contoured so as to provide proper support for the skeletal structure, whereby they promote good posture, thereby permitting the relaxation of the muscles of the body.

Seats of this nature are described in U.S. Pat. Nos. 3,288,525 (CERF); 3,740,096 (BRIDGER) and 3,177,036 (HALTER).

The seats described in these patents are each of a solid one-piece construction. They are moreover, permanently combined with a backrest portion, often the seat and backrest being unitarily molded. Such seats are not suited for easy transportation, for example into stadiums or other public spectator facilities, where the seating provided is often marginal comfort, even for able bodied persons.

Considerable effort has been expended in the past to provide comfortable seating for wheelchairs, for users may be confined for extended periods of time. Moreover, the compressive loading on the gluteus, and on the bony protuberances comprising the ischea and the coccyx may be higher in the case of persons confined to a wheelchair than is otherwise the case, as the reactive forces generated by work effort of the upper body portions will in the main be expended by reactive forces transmitted through the seated areas, whereas a non-confined person may well choose not to be seated at times of higher loadings on the upper body portions.

The seats as envisioned herein are generally for use in conjunction with existing seat units such as chairs, whether wheeled or otherwise. The seat portions of chairs do not conform to any standard, and the front to back distance of such seat portions may vary considerably. Thus, the front to back measurement of the seat portion of a compact wheelchair or a typical secretarial chair is about 35 cms, whereas the seat portion of full size chairs will commonly measure about 45 cms from front to back. The prior art seats are not readily utilizable with a wide variety of different seating units.

As indicated above, orthopedic seats are generally combined into a single unit with an orthopedic backrest. In my U.S. patent, I describe a backrest which is easily portable. It is desirable to provide an orthopedic seat which is also easily portable and which may be readily linked with the backrest, without the use of tools, to form a combination unit.

It is then an object of this invention to provide a readily transportable seat.

It is another object of the invention to provide orthopedic seats that are easily transportable.

It is a further object of the invention to provide orthopedic seats that may be readily adapted for use with different seating units that are already existing.

It is a still further object of the invention to provide a portable seat that may be adapted for use with a variety of seat units without requiring tools or the like.

It is yet another object of the invention to provide a transportable orthopedic seat that may be combined with a suitable backrest to form an orthopedic seating unit.

SUMMARY OF THE INVENTION

In accordance with one aspect of my invention, a seat comprises a rear portion having a forwardly facing transversely disposed bounding edge, a front portion having a rearwardly facing transversely disposed bounding edge, and a mid portion having transversely disposed bounding edges facing the respective bounding edges of the front and rear portions, and hinge means which connects the mid portion to the front and rear portions whereby the portions may be rotated generally about these bounding edges, so that the portions may lie one on the other for convenient transportation.

Preferably the portions are upholstered, and the upholstering material may suitably form a flexible hinge along the whole or substantial part of the length of the facing, transverse edges of at least two of the portions.

Suitably, the front portion attaches to the mid portion by a detachable fastener such as a zipper or loop and pile fastener, whereby it may be detached to shorten the front to back measurement of the seat.

Desirably, the front portion hinge line connecting to the mid portion locates rearwardly of the forward transverse edge of the mid portion, whereby medial portions of the upper surface of the front portion may be approximately in vertical alignment with the forward edge of the mid portion when the front portion is hinged downwardly.

The portions of the seat comprise a support layer and an overlaying foam layer. The support layer will normally be shaped and contoured so as to position the body correctly in relation to the seat, and so as to provide a suitable delocalized support for the skeletal structure, in particular to relieve the pressure on the bony protuberances comprising the tuberous ischea of the pelvis and the coccyx.

These aspects, and other objects and aspects of the invention will become more apparent from the following consideration of a preferred embodiment of the invention, taken in conjunction with the drawings.

BRIEF DESCRIPTION OF THE DRAWINGS

FIG. 1 shows an orthopedic seat in accordance with the invention in upper, front right perspective view;

FIG. 2 is a perspective view from a similar position to FIG. 1, but shows the shell frame structure only of the seat;

FIG. 3 is a cross section along 3—3 of FIG. 2, and shows additionally a foam layer of which the seat is comprised overlaying the shell frame;

DESCRIPTION OF THE PREFERRED EMBODIMENT

Figure 4:
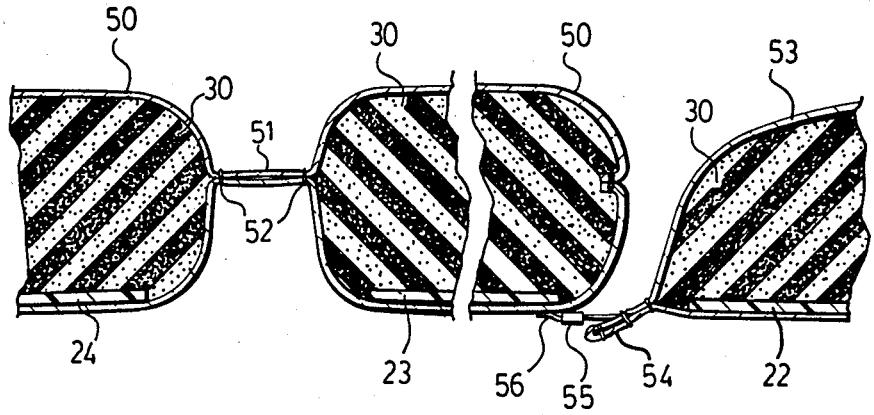
FIG. 4 is a fragmentary cross section along 4—4 of FIG. 2, on enlarged scale, showing in addition foam material and an upholstery cover and the coupling of the seat portions together.

Referring now to the drawings in detail, an orthopedic seat in accordance with the invention is identified therein by the numeral 10. Seat 10 comprises a front portion 12, a mid portion 13 and a rear portion 14.

With particular reference to FIGS. 2 and 3, the seat 10 comprises a support layer 20 and a foam layer 30 overlaying the support layer. The individual portions of the support layer are also numbered from front to rear as 22, 23 and 24 and the portions of the foam layer similarly as 32, 33 and 34. Support layer 20 is resiliently movable under the weight of a user, but is formed of a relatively high tensile strength material so as to resist localized deformation forces such as may be encounted if the seat 10 is employed with a seat platform having an uneven surface. Conveniently support layer 20 amy be cold molded from fibreglass reinforced polyester resin, or injection molded from a so called engineering thermoplastic resin, for example a polycarbonate resin. Expediently support layer 20 may be formed as a single unit, and cut transversely to provide individual portions 22, 23, and 24.

Support layer 20 has an axially aligned central ridge 25, sometimes referred to as the gluteal ridge, for supporting the gluteal muscles. Ridge 25 increases in height from the back to front of the seat 10. The effect of this is to forwardly, upwardly incline the femur, thereby tending to raise the knee joint of a seated person, which has the effect of reducing pressure on the sciatic nerve. The lateral edges 26 and the rear edge 27 of the support layer 20 are gently upswept from adjacent the margins thereof, the transverse cross section of the support layer having a smoothly curved, shallow W shape. The rear edge 27 has a camel back plan profile defining a V shaped cut out 28. Support layer 20 is symmetrical about the central axis thereof. The central ridges 25 and the upswept lateral edges cooperate to assist in positioning the body of a seated user symmetrically in the seat, whereby the coccyx of the user is positioned slightly rearwardly of cutout 28, thereby relieving the pressure thereon, and also on the spine.

Foam layer 30 has a plan form similar to the plan form of support layer 20, but extends beyond the bounding edges of each of the portions 22, 23 and 24. The foam layer 30 is desirably adhered to the support layer 20 for location purposes.

Seat portions 12, 13 and 14 include an upholstering cover 50 which completely envelopes the support layer 20 and overlaying foam layer 30. Conveniently, rear portion 14 and mid portion 13 are contained within a common envelope, the portions being separated by a connecting link 51 of upholstery material, thereby providing a hinge about which the two portions may relatively rotate. The upholstery cover material 50 forming connecting link 51 is stitched together at 52, so as to flatten the link. Preferably, the upholstery material from which the cover 50 is formed is a stretch material, and it is stretched about the foam layer 30 and support layer 20 so as to compress the foam layer 30 somewhat. The extension of the foam layer 30 beyond the bounding edges of support layer portions 22, 23, and 24 acts to increase the radius of curvature adopted by the cover material about the edges of the support layer, so reducing the stress and wear on the material in this area. The extension further serves to provide an axial separation of adjacent portions 12, 13 and 14 of the seat, so as to reduce the risk of flesh being trapped or nipped between the facing transverse edges of these portions. Connecting link 51 also serves somewhat to separate portions 13 and 14.

Front portion 12 of seat 10 is upholstered separately from portions 13 and 14 by a cover 53. Cover 53 is sewn so as to provide a rearwardly, downwardly facing transverse tail 54 along the rearward transverse edge of the front portion. A detachable zip fastener 55 has one selvage sewn to tail 54, the other to the underside of mid portion 13 somewhat rearwardly of the forwardly facing transverse edge thereof at 56. Effectively, the fastener 55 is overlain by the portions 12 and 13 of the seat 10, whereby it is unlikely to snag on the clothing of a user.

A buckled strap 60 secured to cover 50 at the axial mid point of the rear edge 27 of the seat. A tongue 62 also secures to cover 50 at this point, but above strap 60. Tongue 62 is provided at the distal end with a loop pad 63 on one side thereof, and on the opposed side a pile pad 64. A second pile pad 65 locates on the same side as the loop pad 63, but adjacent the proximal end of the tongue.

Figure 6:
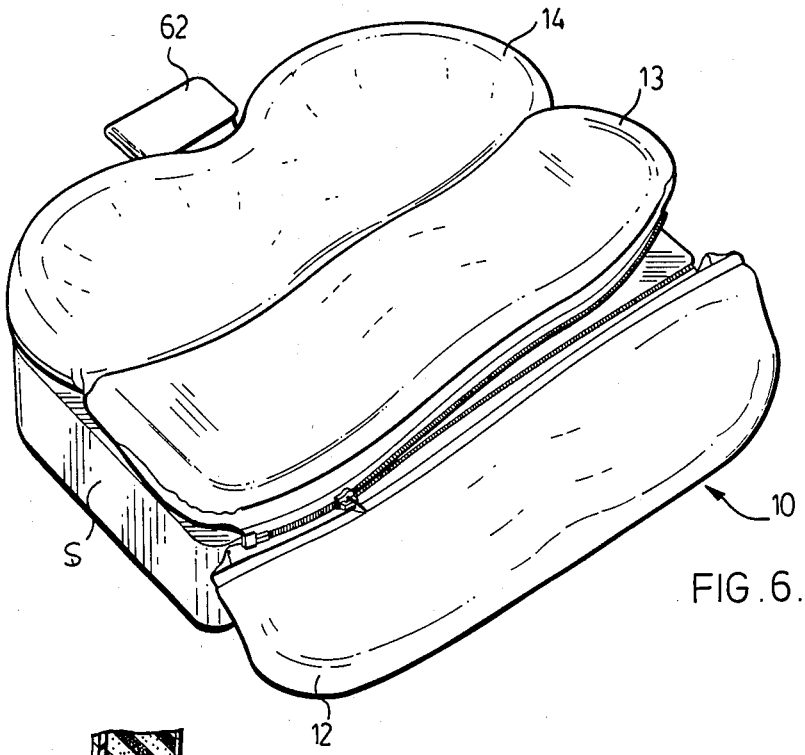
FIG. 6 shows the seat in perspective view with the front portion partially detached.
Figure 7:
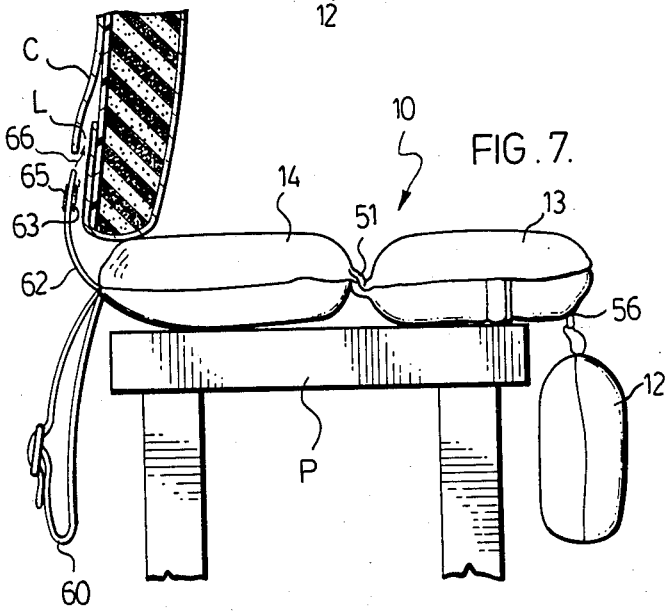
FIG. 7 shows the seat in side elevation with the front portion hanging down over a narrow seat platform, and further shows the manner of coupling the seat to a backrest.

Having described the salient constructional features of the seat 10, the manner of use thereof will now be briefly referred to . With reference to FIG. 1, seat 10 will be used in conjunction with a seating platform (not shown) having a front to back dimension at least approximately equal to the front to back dimension of seat 10. When seat 10 is used in conjunction with a smaller seat platform such as may be provided by the seat S of a secretarial chair (FIG. 6) front portion 12 may be conveniently removed, as suggested by this Figure. Alternately, when used in conjunction with rudimentary seating platforms as suggested by the platform P in FIG. 7, which may well have a rough forwardly facing surface against which the calves of a seated person bear. In this instance, forward portion 12 may be suspended downwardly and it will hinge on stitch line 56 and reside generally rearwardly of the forward edge of mid portion 13.

In use separate from a backrest, tongue 62 is folded over, whereby the loop and pile pads 63 and 65 provided on the same side of the tongue engage together. When it is desired to combine the seat 10 together with a backrest B as suggested in FIG. 7, tongue 62 is unfolded to expose the loop pad 63. This pad may simply be engaged with the fabric cover of backrest B. Preferably, however, where the backrest has a cover C with a loop and pile closure L, tongue 62 is adapted whereby its loop and pile structure at the distal end thereof may be inserted between the loop and pile closure elements L, in the direction of the arrow 66, to engage therewith. A backrest of suitable construction is described in U.S. Pat. No. 4,556,254, commonly assigned herewith.

Figure 5:
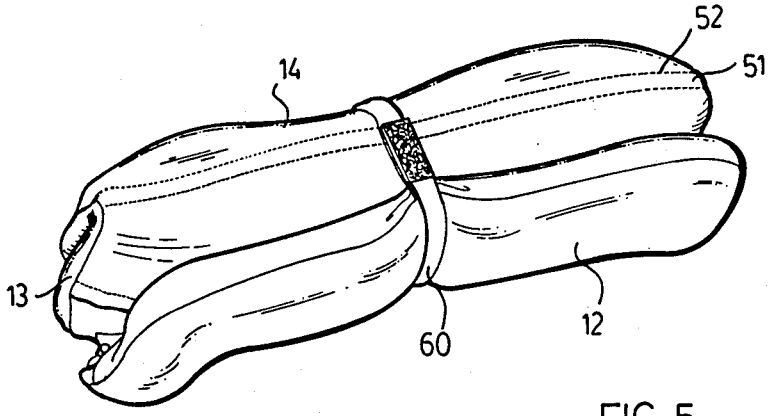
FIG. 5 shows the seat in perspective view folded for carrying.

For transportation of the seat 10, the hinge structure provided by link 51 and fastener 55 permits the three portions 12, 13 and 14 thereof to be folded in concertina fashion, and secured closed by buckled strap 60, as shown in FIG. 5.

The foregoing embodiment is illustrative only of the invention, and it is not to be taken as being limitative of at least the broad aspects of the invention, as many variations thereof may be made, and such variations are intended to fall within the scope of the claims appended hereto.

I claim:

1. A portable seat comprising:

a rear portion having a forwardly facing transverse bounding margin;

a front portion having a rearwardly facing transverse bounding margin;

a mid portion having transverse bounding margins facing the respective bounding margins of said front portions and said rear portions;

each said portion consisting essentially of a rigid, resilient, unitary support layer and a foam layer overlaying each said support layering;

each said portion being completely surrounded by an upholstered finish, and hinge means joining said portions along the length of the bounding margins thereof, wherein each said support layer of each said portion has a central upstanding ridge which extends to its forward transverse bounding margin, and wherein the lateral edges of each said support layer and the rear edge of the support layer of the rear portion are upturned, and wherein the rearward transverse edge of the support layer of said rear portion has a V-shaped cut out therein centrally located thereon.

2. A portable seat as defined in claim 1, wherein said hinge means permits said portions to be folded in overlaying relationship.

3. A portable seat as defined in claim 1, wherein said upholstered finish forms a hinge between at least two said portions.

4. A portable seat as defined in claim 3, wherein the forward portion is hingedly connected to the mid portion by means which permits the detachment of the forward portion therefrom and the reattachment thereto without the use of tools.

5. A portable seat as defined in claim 4, wherein said hinge means connecting said forward portion to said mid portion has a hinge line located rearwardly of the forward transverse margin of said mid portion.

6. A portable seat as defined in claim 1, wherein each said support layer has a central upstanding ridge which increases in height towards the front of said seat.

7. A portable seat as defined in claim 1, wherein said foam layer overhangs the bounding lateral margin of each said portion of said support layer.

8. A portable seat as defined in claim 1, comprising connector means for detachably securing said seat to a back rest.

9. A portable seat as defined in claim 1, including handle means adapted to bundle said seat into a compact, folded unit.

* * * * *